US010316786B2

(12) United States Patent
Ranga et al.

(10) Patent No.: US 10,316,786 B2
(45) Date of Patent: Jun. 11, 2019

(54) METHODS AND SYSTEMS FOR ADJUSTING A DIRECT FUEL INJECTOR

(71) Applicant: Ford Global Technologies, LLC, Dearborn, MI (US)

(72) Inventors: Adithya Pravarun Re Ranga, Canton, MI (US); Gopichandra Surnilla, West Bloomfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 826 days.

(21) Appl. No.: 14/556,821

(22) Filed: Dec. 1, 2014

(65) Prior Publication Data

US 2016/0153387 A1 Jun. 2, 2016

(51) Int. Cl.

*F02D 41/30* (2006.01)
*F02D 41/14* (2006.01)
*F02D 41/24* (2006.01)

(52) U.S. Cl.

CPC ..... *F02D 41/3094* (2013.01); *F02D 41/1454* (2013.01); *F02D 41/2467* (2013.01)

(58) Field of Classification Search

CPC ..... F02D 2250/31; F02D 41/3094; F02D 41/3845; F02D 2041/3881; F02D 2041/389; F02D 2200/0602; F02D 41/10; F02D 41/126; F02D 41/3836; F02D 41/40; F02D 41/407; F02M 63/024; F02M 69/046; Y02T 10/04

See application file for complete search history.

(56) References Cited

U.S. PATENT DOCUMENTS 4,615,319 A * 10/1986 Tomisawa ..... F02D 41/107 123/675
4,774,858 A * 10/1988 Ganoung ..... B60W 10/06 477/100
5,448,977 A 9/1995 Smith et al.
5,887,566 A * 3/1999 Glauber ..... F02D 19/105 123/27 GE
5,890,459 A * 4/1999 Hedrick ..... F02B 69/02 123/27 GE
6,244,241 B1 * 6/2001 Mamiya ..... F02D 41/2461 123/295
6,701,905 B1 3/2004 Gaskins
7,841,319 B2 11/2010 Thomas
8,239,119 B2 8/2012 Bagnasco et al.
8,290,687 B2 10/2012 Olbrich et al.

(Continued)

OTHER PUBLICATIONS

Parotto, Marco et al., "Advanced GDI Injector Control with Extended Dynamic Range," SAE Technical Paper Series No. 2013-01-0258, published Apr. 8, 2013, 9 pages.

(Continued)

*Primary Examiner* — David E Hamaoui
*Assistant Examiner* — Carl C Staubach
(74) *Attorney, Agent, or Firm* — Julia Voutyras; McCoy Russell LLP

(57) ABSTRACT

Systems and methods for improving fuel injection of an engine that includes a cylinder receiving fuel from two different fuel injectors is disclosed. In one example, a transfer function or gain of a direct fuel injector is adjusted in response to an exhaust lambda value and a first pulse width of two pulse widths provided to an injector of a cylinder during a cylinder cycle.

17 Claims, 4 Drawing Sheets

(56) References Cited

U.S. PATENT DOCUMENTS

| | | | | |
|---|---|---|---|---|
| 8,700,288 | B2 | 4/2014 | Huber et al. | |
| 9,212,640 | B2 * | 12/2015 | Serra | F02M 65/003 |
| 9,611,823 | B2 * | 4/2017 | Schwarte | F02M 51/00 |
| 9,650,983 | B2 * | 5/2017 | Gautier | F02D 41/3005 |
| 9,689,342 | B2 * | 6/2017 | Ranga | F02D 41/402 |
| 2003/0029414 | A1 * | 2/2003 | Boss | F02D 41/2096 123/294 |
| 2003/0120417 | A1 * | 6/2003 | Koerner | F02D 41/2422 701/104 |
| 2005/0166896 | A1 * | 8/2005 | Sadakane | F02D 41/3029 123/431 |
| 2006/0201476 | A1 * | 9/2006 | Brachert | F02B 11/02 123/299 |
| 2009/0308367 | A1 * | 12/2009 | Glugla | F02D 19/081 123/575 |
| 2009/0326789 | A1 * | 12/2009 | Franks | F02D 41/1498 701/111 |
| 2010/0305831 | A1 * | 12/2010 | Bagnasco | F02D 41/2438 701/103 |
| 2012/0000197 | A1 * | 1/2012 | Maruyama | F02D 41/0057 60/605.2 |
| 2013/0231806 | A1 | 9/2013 | Bailey et al. | |
| 2016/0153386 | A1 * | 6/2016 | Ranga | F02D 41/3094 701/104 |
| 2016/0153390 | A1 * | 6/2016 | Ranga | F02D 41/402 701/104 |
| 2016/0153391 | A1 * | 6/2016 | Ranga | F02D 41/402 701/104 |
| 2016/0169147 | A1 * | 6/2016 | Surnilla | F02D 41/2467 123/299 |
| 2016/0281624 | A1 * | 9/2016 | Dames | F02D 41/40 |

OTHER PUBLICATIONS

Ranga, Adithya Pravarun Re et al., "Methods and Systems for Learning Variability of a Direct Fuel Injector," U.S. Appl. No. 14/556,615, filed Dec. 1, 2014, 35 pages.

Ranga, Adithya Pravarun Re et al., "Methods and Systems for Adjusting Fuel Injector Operation," U.S. Appl. No. 14/556,752, filed Dec. 1, 2014, 33 pages.

Ranga, Adithya Pravarun Re et al., "Methods and Systems for Adjusting a Direct Fuel Injector," U.S. Appl. No. 14/556,674, filed Dec. 1, 2014, 40 pages.

* cited by examiner

METHODS AND SYSTEMS FOR ADJUSTING A DIRECT FUEL INJECTOR

FIELD

The present description relates to a system and methods for adjusting operation of a fuel injector for an internal combustion engine. The methods may be particularly useful for an engine that includes both port and direct fuel injectors.

BACKGROUND AND SUMMARY

Fuel may be directly injected to an engine cylinder to improve mixture preparation and to reduce cylinder charge temperature. The amount of time a direct fuel injector is activated may be a function of pressure of fuel supplied to the direct fuel injector, engine speed, and engine load. The pressure of fuel supplied to the direct fuel injector may be elevated by transferring heat from an engine to fuel as fuel is delivered to a fuel rail supplying the direct fuel injectors. The higher fuel pressure may increase a flow rate of fuel through the direct injector such that a fuel pulse width supplied to operate the direct fuel injector may need to be adjusted to a short duration of time (e.g., less than 500 micro-seconds). However, operating the direct fuel injector with a short pulse width voltage command may cause the direct fuel injector to operate in its non-linear or ballistic operating range where the amount of fuel injected may vary substantially for small changes in the fuel pulse width. Additionally, deposits formed at the injector's nozzle may also contribute to an unintended amount of fuel flowing through the direct fuel injector. Consequently, the direct fuel injector may not provide a desired amount of fuel when shorter duration pulse widths are applied to the direct fuel injector.

The inventors herein have recognized the above-mentioned disadvantages and have developed a method for fueling a cylinder, comprising: supplying a first pulse width and a second pulse width to a fuel injector during a cylinder cycle, where the first pulse width operates the fuel injector in a non-linear operating region, and where the second pulse width operates the fuel injector in a non-ballistic operating region; adjusting a control parameter of the fuel injector in response to exhaust lambda; and operating the fuel injector based on the adjusted control parameter.

By supplying two pulse widths to a fuel injector during a cycle of a cylinder receiving fuel from the fuel injector, it may be possible to provide the technical result of adjusting a fuel injector transfer function or gain without having to operate the cylinder with an air-fuel ratio that may be leaner or richer than is desired. In particular, a first pulse width supplied to a fuel injector may be short enough in duration to operate the fuel injector in its non-linear low flow region. A second pulse width supplied to the fuel injector during a same cylinder cycle may be long enough to operate the fuel injector in its linear operating range so that a fuel amount closer to a desired fuel amount may be supplied to the cylinder during the cylinder cycle. Consequently, if fuel supplied by the fuel injector in response to the first pulse width is greater or less than a desired amount, the aggregate air-fuel mixture during the cylinder cycle may be less affected because a greater amount of a desired fuel amount to be injected to the cylinder may be provided via the second pulse width operating the fuel injector.

The present description may provide several advantages. In particular, the approach may reduce engine air-fuel errors. Additionally, the approach may allow a fuel injector to be operated at pulse widths that were heretofore avoided because of non-linear fuel injector behavior. Further, the approach may reduce engine emissions and improve catalyst efficiency.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The advantages described herein will be more fully understood by reading an example of an embodiment, referred to herein as the Detailed Description, when taken alone or with reference to the drawings, where.

DETAILED DESCRIPTION

Figure 1:
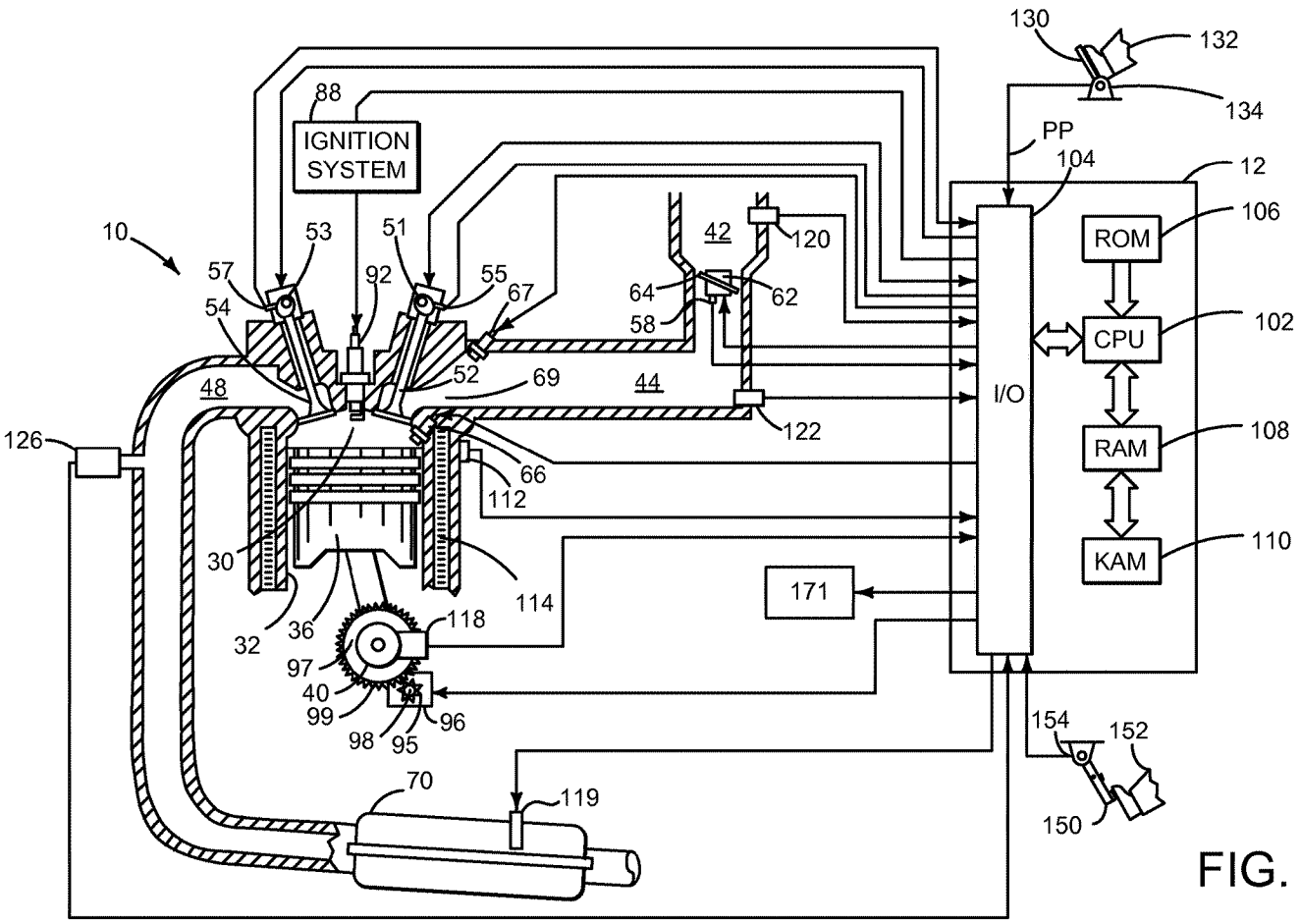
FIG. 1 is a schematic diagram of an engine.
Figure 3:
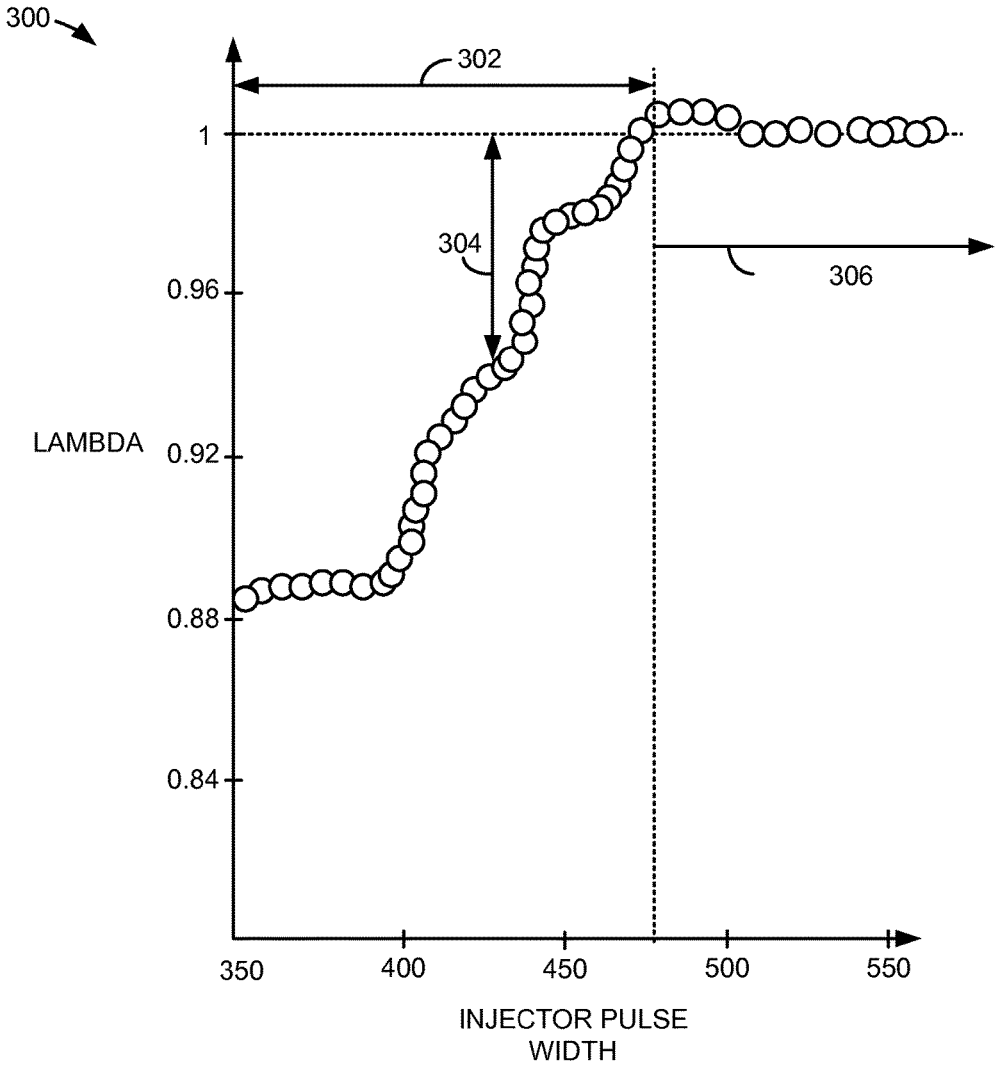
FIG. 3 shows a prophetic example plot of engine lambda versus fuel injector pulse width for a fuel injector operating in its ballistic operating region.
Figure 4:
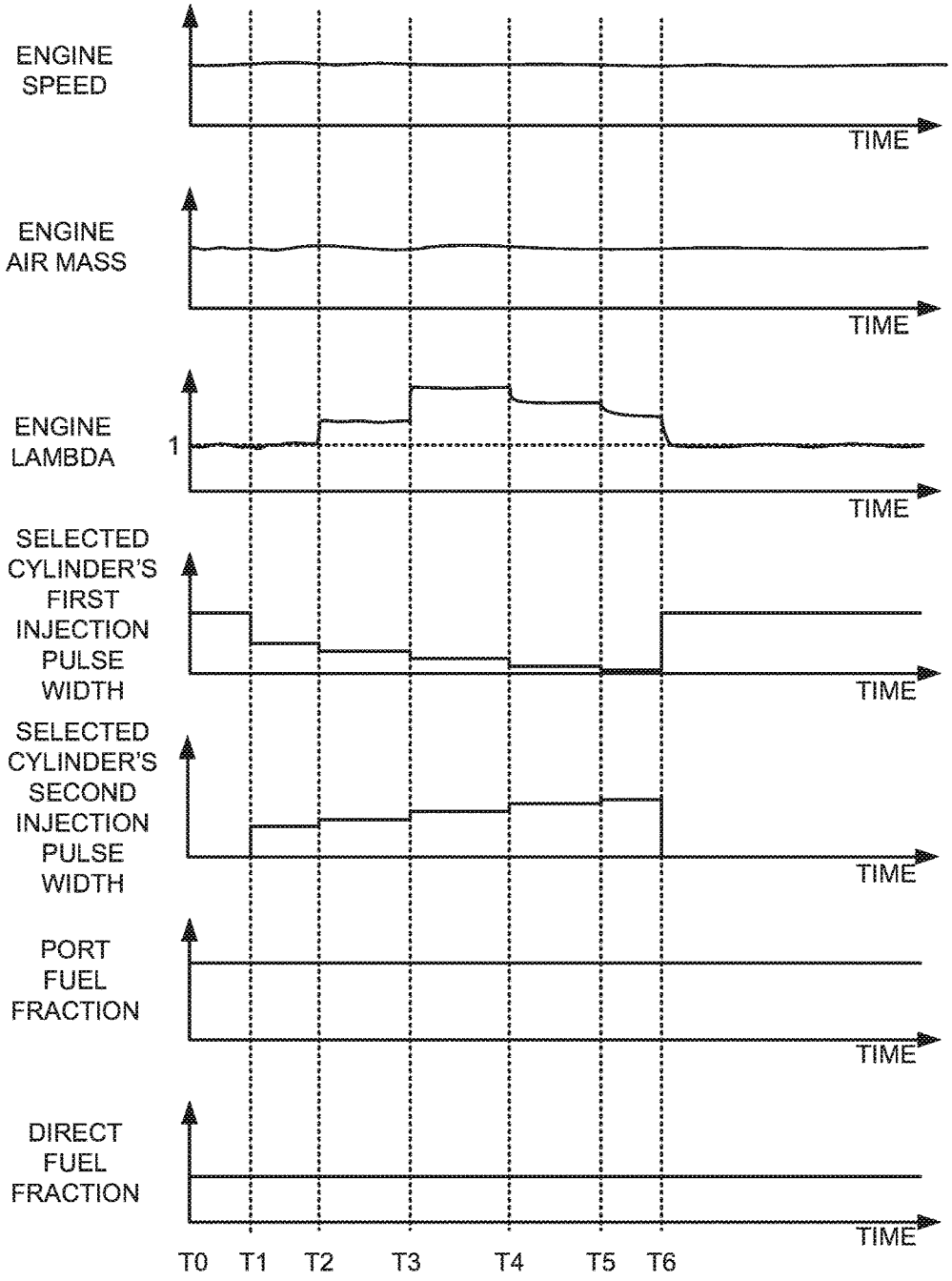
FIG. 4 shows a fuel injector operating sequence for adjusting fuel injector operation according to the method of FIG. 2.

The present description is related to correcting a fuel injector transfer function and operating fuel injectors based on the revised fuel injector transfer function. Fuel injectors may be incorporated into an engine as is shown in FIG. 1. The engine may be operated according to the method of FIG. 2 to update one or more fuel injector transfer functions. A fuel injector transfer function may be revised in a fuel injector's non-linear operating region based on engine lambda as is shown in FIG. 3. An engine may be operated as shown in the sequence of FIG. 4 according to the method of FIG. 2 to revise a fuel injector's transfer function.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Flywheel 97 and ring gear 99 are coupled to crankshaft 40. Starter 96 includes pinion shaft 98 and pinion gear 95. Pinion shaft 98 may selectively advance pinion gear 95 to engage ring gear 99. Starter 96 may be directly mounted to the front of the engine or the rear of the engine. In some examples, starter 96 may selectively supply torque to crankshaft 40 via a belt or chain. In one example, starter 96 is in a base state when not engaged to the engine crankshaft. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. The position of intake cam 51 may be determined by intake cam sensor 55. The position of exhaust cam 53 may be determined by exhaust cam sensor 57.

Direct fuel injector 66 is shown positioned to inject fuel directly into cylinder 30, which is known to those skilled in the art as direct injection. Port fuel injector 67, injects fuel to intake port 69, which is known to those skilled in the art as port injection. Fuel injector 66 delivers liquid fuel in proportion to a voltage pulse width or fuel injector pulse width of a signal from controller 12. Likewise, fuel injector 67 delivers liquid fuel in proportion to a voltage pulse width or fuel injector pulse width from controller 12. Fuel is delivered to fuel injectors 66 and 67 by a fuel system (not shown) including a fuel tank, fuel pump, and fuel rail (not shown). Fuel is supplied to direct fuel injector 66 at a higher pressure than fuel is supplied to port fuel injector 67. In addition, intake manifold 44 is shown communicating with optional electronic throttle 62 which adjusts a position of throttle plate 64 to control air flow from air intake 42 to intake manifold 44. In some examples, throttle 62 and throttle plate 64 may be positioned between intake valve 52 and intake manifold 44 such that throttle 62 is a port throttle.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only memory 106 (e.g., non-transitory memory), random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing force applied by foot 132; a position sensor 154 coupled to brake pedal 150 for sensing force applied by foot 152, a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120; and a measurement of throttle position from sensor 58. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

In some examples, the engine may be coupled to an electric motor/battery system in a hybrid vehicle. Further, in some examples, other engine configurations may be employed, for example a diesel engine with multiple fuel injectors. Further, controller 12 may communicate conditions such as degradation of components to light, or alternatively, display panel 171.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

Thus, the system of FIG. 1 provides for a system, comprising: an engine including a cylinder; a port fuel injector in fluidic communication with the cylinder; a direct fuel injector in fluidic communication with the cylinder; and a controller including executable instructions stored in non-transitory memory for commanding the engine to operate at a constant air-fuel ratio while supplying fuel to the cylinder via the port fuel injector and the direct fuel injector, additional instructions for providing two injections of fuel via the direct fuel injector while supplying fuel to the cylinder via the port fuel injector and the direct fuel injector in response to a request to adjust a control parameter of the second fuel injector. The system includes where the control parameter is a gain or a transfer function.

In some examples, the system further comprises additional instructions to decrease a first injection amount provided by the second fuel injector and increase a second fuel injection amount provided by the second fuel injector in response to the request to adjust the control parameter. The system includes where the transfer function or gain is adjusted based on an exhaust lambda. The system includes where the first fuel injector is a port fuel injector and where the second fuel injector is a direct fuel injector. The system further comprises additional instructions to operate other cylinders of the engine via only injecting fuel to the other cylinders via port injectors during an engine cycle where the first pulse width and the second pulse width are supplied to the second fuel injector.

Figure 2:
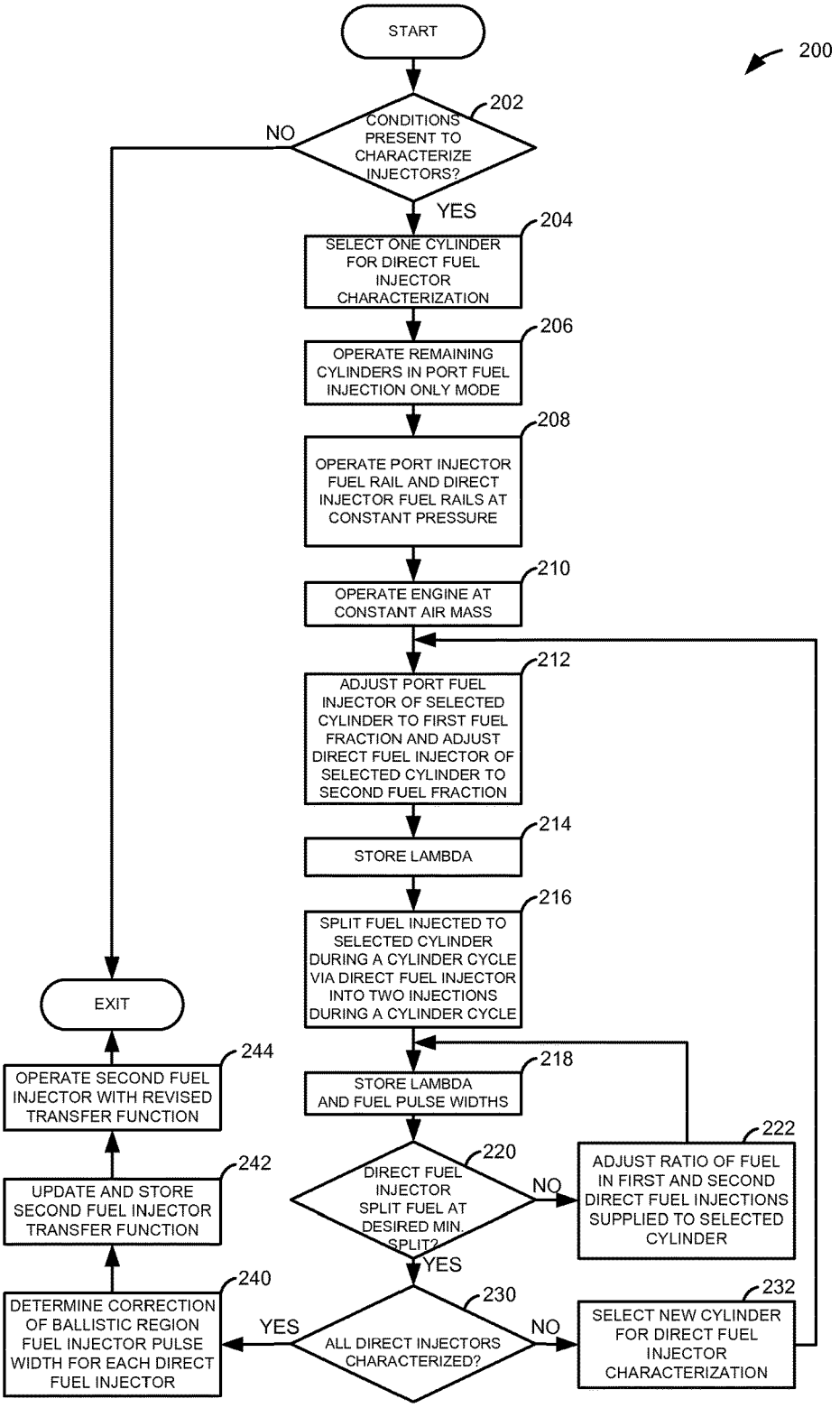
FIG. 2 shows a method for adjusting fuel injector operation.

Referring now to FIG. 2, a method for revising a fuel injector transfer function and operating an engine based on the revised transfer function is shown. The method of FIG. 2 may be included in the system of FIG. 1 as executable instructions stored in non-transitory memory. Further, the method of FIG. 2 may provide the operating sequence of FIG. 4.

At 202, method 200 judges if conditions are present for characterizing fuel injectors and adapting fuel injector operation. In one example, method 200 may judge that conditions are present for characterizing fuel injectors when an engine is idling with zero driver demand torque. In other examples, method 200 may judge that conditions are present for characterizing fuel injectors when the engine is operating at a constant engine speed and load, such as when a vehicle is in cruise control mode on a flat road. If method 200 judges that conditions are present for characterizing fuel injectors, the answer is yes and method 200 proceeds to 204.

At 204, method 200 selects one cylinder from a group of engine cylinders for direct fuel injector characterization. In other words, a direct fuel injector of a cylinder is selected to determine if the direct fuel injector transfer function accurately describes direct fuel injector operation or fuel flow. The direct fuel injector's gain or transfer function describes fuel flow through the direct fuel injector and/or an amount of fuel delivered via the direct fuel injector based on a pulse width of a voltage supplied to the direct fuel injector. In one example, method 200 begins by selecting a direct fuel injector of cylinder number one. However, in other examples, other cylinders may be selected. Method 200 proceeds to 206 after the cylinder is selected.

At 206, method 200 operates engine cylinders other than the selected cylinder in a port fuel injection mode. Fuel is injected to the engine's other cylinders only via port fuel injectors. Direct fuel injectors that supply fuel to the engine's other cylinders are deactivated. In this way, operation of the selected direct fuel injector may be decoupled from operation of other direct fuel injectors. Method 200 proceeds to 208 after the engine's cylinders other than the selected cylinder are operated in a port fuel injection only mode.

At 208, method 200 supplies fuel to port fuel injector rails at a constant pressure. Additionally, method 200 supplies fuel to direct fuel injector rails at a constant pressure. By supplying fuel to the fuel rails at a constant pressure, it may be possible to more accurately characterize fuel injector fuel flow rate and amount of fuel injected. Method 200 proceeds to 210 after fuel at constant pressure is supplied to the fuel rails.

At 210, method 200 operates the engine with a constant air mass. The engine may be operated with a constant air mass via adjusting a position of a throttle or other air control device as engine speed changes. If engine speed remains constant, the position of the air mass adjusting device may remain unchanged. The constant air mass may be a predetermined amount such as an air amount to idle the engine or an air amount to maintain a constant vehicle speed at present vehicle operating conditions. By operating the engine with a constant air mass, it may be possible to ascertain fuel injector fuel delivery errors more accurately since the engine's air-fuel ratio may be less likely to change from air charge errors. Method 200 proceeds to 212 after beginning to operate the engine with a constant air mass.

At 212, method 200 adjusts a first fuel injector supplying fuel to the selected cylinder to deliver a first fuel fraction, and method 200 adjusts a second fuel injector supplying fuel to the selected cylinder a second fuel fraction. The first fuel injector may be a port fuel injector and the second fuel injector may be a direct fuel injector. A fuel fraction is a fraction of an amount of fuel delivered to the cylinder during a cylinder cycle of the selected cylinder. The fuel fraction of the first fuel injector and the fuel fraction of the second fuel injector add to a value of one. Thus, for example, the first fuel injector may be adjusted to a fuel fraction of 0.6 and the second fuel injector may be adjusted to a fuel fraction of 0.4. Consequently, if X grams of fuel are provided to the cylinder via the first and second fuel injectors, the first fuel injector supplies 0.6·X grams of fuel and the second fuel injector supplies 0.4·X grams of fuel.

In one example, where operation of the first fuel injector is not being characterized and where operation of the second fuel injector is being characterized, the first fuel injector is adjusted to a greater fuel fraction than the second fuel injector, 0.6 for example. Further, the fuel fraction of the second fuel injector may be adjusted such that the second fuel injector operates at fuel injector pulse width where fuel injector flow is linear, but close to where fuel injector flow is non-linear (e.g., near but not in a ballistic region of fuel injector operation). Method 200 proceeds to 214 after the fuel fractions of the first and second fuel injectors are selected and applied.

At 214, method 200 determines the lambda value the engine is operating at based on output from an exhaust gas oxygen sensor. The lambda value is the engine's present air-fuel ratio divided by the stoichiometric air fuel ratio (e.g., 14.3/14.64=0.977). The oxygen sensor outputs a voltage that is converted to engine air-fuel ratio via an oxygen sensor transfer function. The present value of lambda is stored to controller memory. Additionally, the second fuel injector's pulse width may also be stored to memory. Method 200 proceeds to 216 after the lambda value is stored to memory.

At 216, method 200 splits the amount of fuel injected to the selected cylinder via the second fuel injector into two fuel injections during a cycle of the selected cylinder. The two injections are provided by supplying the second fuel injector two voltage pulse widths or injection pulse widths. In one example, the amount of fuel commanded in the two pulse widths adds up to an amount of fuel that when combined with the selected cylinder's air amount and the port injected fuel is based on providing a lambda value of one in the selected cylinder. For example, if X grams of fuel are needed to operate the selected cylinder at a lambda value of one and the port fuel injectors (e.g., the first injector) inject 0.6·X, then the amount of fuel injected via the first and second pulse widths is desired to be 0.4·X. Consequently, the amount of fuel injected by the second fuel injector may be a first amount 0.2·X, and a second amount 0.2·X, when the first fuel injection amount provided by the first pulse width is equal to the second fuel injection amount provided by the second pulse width, the first and second pulse widths provided to the second fuel injector (e.g., the direct fuel injector). Thus, in this example, the amount of fuel injected based on the first pulse width supplied to the second fuel injector is fifty percent of the fuel injected by the second fuel injector during the cylinder cycle. The amount of fuel injected based on the second pulse width supplied to the second fuel injector is fifty percent of fuel injected by the second fuel injector during the cylinder cycle. It should be noted that the example provided herein is only exemplary. The first and second fuel injections may be adjusted between zero and one hundred percent for the first injection or vise-versa. Method 200 proceeds to 218 after the first and second pulse widths provided to the second fuel injector of the selected cylinder are adjusted to a predetermined split of fuel delivered between the two pulse widths.

At 218, method 200 determines the lambda value the engine is operating at based on output from an exhaust gas oxygen sensor. The lambda value is the engine's present air-fuel ratio divided by the stoichiometric air fuel ratio. The oxygen sensor outputs a voltage that is converted to engine air-fuel ratio via an oxygen sensor transfer function. The present value of lambda is stored to controller memory. Additionally, the second fuel injector's two pulse widths may also be stored to memory. Errors between the second fuel injector's shortest pulse width (e.g., the first pulse width) for delivering the desired engine air-fuel ratio and the lambda value observed by the exhaust oxygen sensor may indications of errors in the second fuel injectors transfer function in the second fuel injector's ballistic operating region. Injector pulse widths that are greater than a pulse width that operates the second fuel injector in a linear mode are expected to have a smaller effect on lambda errors. Method 200 proceeds to 220 after the lambda value is stored to memory.

At 220, method 200 judges if a first pulse width supplied to the second fuel injector during a cylinder cycle is at a minimum desired pulse width. In one example, the minimum desired pulse width is a pulse width of a first pulse width supplied to the second fuel injector during a cycle of the selected cylinder. However, in other examples, the minimum desired pulse width is a pulse width of a second pulse width supplied to the second fuel injector during a cycle of the selected cylinder. The minimum pulse width may be a predetermined value such as 100 micro-seconds. The minimum pulse width is a pulse width that operates the second fuel injector in its non-linear or ballistic operating region where fuel flow through the second fuel injector is non-linear.

If method 200 judges that the first or second pulse width supplied to the second fuel injector (e.g., the direct fuel injector) is less than a threshold pulse width, if the answer is yes method 200 proceeds to 230. Otherwise, the answer is no and method 200 proceeds to 222.

At 222, method 200 decreases the first pulse width provided to the second fuel injector during a cycle of the selected cylinder and increases the second pulse width provided to the second fuel injector during the cycle of the selected cylinder. By decreasing the first pulse width, the second fuel injector is commanded to inject less fuel and to operate closer to or deeper into a non-linear operating range of the second fuel injector during the cylinder cycle. Increasing the second pulse width commands the second fuel injector to inject more fuel and to operate further away from the non-linear operating range of the second fuel injector during the cylinder cycle. Thus, the first pulse width drives the second fuel injector to operate the second fuel injector closer to or deeper into the second fuel injector's non-linear operating region during a cylinder cycle. After the first pulse width is delivered to the second fuel injector, the second pulse width is supplied to the second fuel injector during the same cylinder cycle. The second fuel pulse width operates the second fuel injector further into the linear operating range of the second fuel injector. Further, the amount of fuel removed from the first fuel injection during the cylinder cycle by reducing the first pulse width is added to the second fuel injection amount during the cylinder cycle by increasing the second pulse width. In this way, the second fuel injector may be driven into its non-linear operating range in a way that reduces engine fueling errors yet provides ability to determine fuel injector fueling errors. Method 200 returns to 218 to record the effects of adjusting the fuel pulse widths applied to the second fuel injector of the selected cylinder.

At 230, method 200 judges whether or not operation of all the engine's direct fuel injectors have been characterized. If operation of all direct fuel injectors has not been characterized, the answer is no and method 200 proceeds to 232. Otherwise, the answer is yes and method 200 proceeds to 240.

At 232, method 200 selects a new cylinder from the cylinders that have not had their second fuel injectors (e.g., direct fuel injectors) characterized. For example, if cylinder number one has had its second fuel injector supplying fuel characterized, cylinder number two is selected. Additionally, the previously selected cylinder is operated in port fuel injection only mode. Method 200 returns to 212 after a new cylinder is selected for fuel injector characterization.

At 240, method 200 determines corrections for ballistic or non-linear regions of second fuel injectors of all engine cylinders. The corrections are made to nominal pulse widths (e.g., existing transfer function values) of the second fuel injector at the pulse widths the fuel injector operated at in steps 218 to 222 during the time the fuel injection split ratio was adjusted. In one example, the fuel pulse width correction for each incremented fuel pressure is determined via the following equation:

$$Total\%reduction = \frac{\%change_in_lambda_at_the_pw_from_nom * num_cylinders_per_bank}{difrac \cdot displitrato}$$

where Total%reduction is the correction applied to the transfer function of the second fuel injector of the selected cylinder at a particular second fuel injector pulse width, %change_in_lambda_at_the_pw_from_nom is the percent change in the observed lambda value for the complete bank at the particular pulse width from the lambda value of the bank at the fuel pulse width applied when the second fuel injector is supplied fuel based on the initial pulse width (e.g., lambda value at 214), num_cylinders_per_bank is the number of cylinders present on the bank (e.g. a V6 engine may have 3 cylinders per bank, and an 14 engine may have 4 cylinders in one bank), difrac is the fraction of fuel injected to the cylinder during a cylinder of the cylinder via the second or direct fuel injector, and displitratio is the ratio between the first fuel pulse width and the second fuel pulse width supplied to the second fuel injector (e.g., direct fuel injector) of the selected cylinder. The correction may be determined for and applied to all second fuel injectors of the selected cylinders based on lambda values and pulse widths stored at 218. Thus, the corrections may be supplied to all second fuel injectors of all engine cylinders.

In one example, the second fuel injector's pulse width for a V6 engine is one millisecond before being split (e.g., at 212), and after the 1 millisecond pulse width is split into a first pulse width of 0.45 milliseconds and a second pulse width of 0.55 milliseconds the split ratio is 0.45. If the fuel fraction was 0.7 for the second fuel injector or direct fuel injector and the lambda value decreased by 5%. Then the total reduction is 5*3/(0.7*0.45), or the 5 percent multiplied by number of cylinders per bank and divide by the direct fuel injection ratio multiplied by the split ratio. The transfer function for the commanded pulse width for these operating conditions is adjusted by 48 percent. Method 200 performs similar adjustments to the second fuel injector's transfer function at all pulse widths the second fuel injector was operated at between steps 218 and 222.

At 242, the values stored in a table or function that represents the transfer function of the second fuel injector are revised by multiplying values stored in the transfer function by the corresponding injector correction determined at 240 and storing the result back into the second fuel injector transfer function. For example, if the second fuel injector transfer function describes the second fuel injector's flow at the 400 micro-second pulse width as Z, and the correction determined at 240 for the 400 micro-second pulse width is 10%, the revised value stored in the second fuel injector's transfer function is 0.1·Z. Revisions for when the second fuel injector is provided pulse widths other than 400 micro-seconds are also performed for each decrement in fuel pulse width performed at 222. Likewise, revisions for transfer functions of other cylinder's second fuel injectors may be performed similarly. In cases where a single transfer function describes operation of all the engine's cylinders second fuel injectors, the single transfer function is adjusted similarly. Method 200 stores the revised transfer function or functions in memory and proceeds to 244.

At 244, method 200 operates the engine via supplying fuel to engine cylinders based on the revised and stored second fuel injector transfer functions. For example, pulse widths are provided to each engine cylinder's second fuel injector, the pulse widths are based on a desired fuel mass to be delivered to a cylinder during a cycle of the cylinder and the transfer function that outputs a fuel injector pulse width according to a desired mass of fuel to be injected to the cylinder. Method 200 proceeds to exit after engine cylinders are operated in response to one or more revised second fuel injector transfer functions.

Consequently, the method of FIG. 2 provides for a method for fueling a cylinder, comprising: supplying a first pulse width and a second pulse width to a fuel injector during a cylinder cycle, where the first pulse width operates the fuel injector in a non-linear operating region, and where the second pulse width operates the fuel injector in a non-ballistic (e.g., linear) operating region; adjusting a control parameter of the fuel injector in response to exhaust lambda; and operating the fuel injector based on the adjusted control parameter. The method includes where the non-linear operating region is an operating region where fuel flow through the fuel injector is non-linear.

In some examples, the method includes where the control parameter is a fuel injector gain or transfer function. The method includes where the adjusted control parameter is stored to memory. The method includes where the fuel injector is a direct fuel injector, where the first pulse width and the second pulse width are based on a fuel injector transfer function, and where the first and second fuel pulse are based on providing an engine lambda value of one. The method includes where the cylinder is in an engine, and where the engine is operated at a constant speed and air mass when the fuel injector is operated in the non-linear mode. The method includes where the fuel injector is a direct fuel injector and where an engine in which the direct fuel injector operates to supply fuel to a cylinder operates with only port fuel injectors supplying fuel to the engine's other cylinders when the direct fuel injector is operating in the non-linear operating region.

In some examples, the method of FIG. 2 provides for a method for fueling a cylinder, comprising: operating an engine at a constant speed and air mass; supplying a first fuel fraction to a cylinder of the engine via a first fuel injector while supplying a second fuel fraction to the cylinder via a second fuel injector; and supplying a first pulse width and a second pulse width to the second fuel injector during a cylinder cycle in response to a request to characterize the second fuel injector; adjusting a control parameter of the second fuel injector in response to exhaust lambda produced while the second fuel injector is operating in a non-linear region; and operating the second fuel injector based on the adjusted control parameter.

The method includes where the first fuel injector is a port fuel injector, and where the second fuel injector is a direct fuel injector. The method further comprises decreasing the first pulse width and increasing the second pulse width. The method includes where fuel delivered to via the first pulse width and the second pulse width is based on providing a mixture in the cylinder having a lambda value of one. The method also includes where the control parameter is a transfer function or gain. The method further comprises commanding the engine to operate at a constant air-fuel ratio while operating at the constant speed and air mass. The method further comprises supplying fuel to other engine cylinders only via port fuel injectors while supplying the first pulse width and the second pulse width to the second fuel injector.

Referring now to FIG. 3, an example plot of a fuel injector correction amount versus fuel injector pulse width for a fuel injector operating in a non-linear or ballistic region is shown. The fuel injectors shown in FIG. 1 may operate similar to the way shown in FIG. 3.

The X axis represents fuel injector pulse width. A fuel injector pulse width may vary in duration from zero to tens of milliseconds. The Y axis represents a fuel flow correction from a nominal fuel injector flow rate. A nominal correction has a value of 1. When the fuel injector flow is less than nominal, the correction factor is a fraction of nominal (e.g., 0.8). As we apply this correction factor as (1/0.8). When the fuel injector flow is more than the nominal, the correction factor is more than 1 (e.g., 1.1). The circles represent individual data values for different fuel injector pulse widths.

In this example, the fuel injector begins to operate in a non-linear or ballistic range when fuel pulse widths are less than about 500 micro seconds (0.5 milli seconds). This range is indicated by leader 302. At higher or longer pulse widths, the fuel injector flow is a nominal amount as indicated by the value of one when fuel injector pulse widths are greater than 500 micro seconds (0.5 milli seconds). This range is indicated by leader 306. When the fuel injector described by plot 300 is operated with a 450 micro-second pulse width, fuel injector flow is about 80 percent of nominal fuel injector flow rate as indicated by leader 304. This indicates that as we move in the low pulse width region, the amount of fueling decreases by a greater extent than what is expected. Thus, the fuel flow rate of this particular fuel injector is decreased when the fuel injector is supplied a 450 micro-second injection pulse. So, if at a 450 micro-seconds pulse width, there is about 80% of fueling as compared to the nominal fueling amount for the particular injector. This means when you request a fuel flow of 1 for the injector at 450 micro-seconds it actually delivers 0.8. Hence the correction factor is 0.8 and we need to request−1/correction factor (i.e., 1/0.8=1.25) times fuel to operate the injector at nominal flow of 1.

The correction factor is reduced further in response to fuel injector pulse widths that are less than 500 micro-seconds. At fuel injector pulse widths greater than 500 micro seconds, the correction from nominal is one (e.g., no correction). The fuel injector's nominal flow rate may be multiplied by the correction to provide the injector's fuel flow rate when a particular pulse width is applied to the fuel injector.

A plurality of correction values shown in FIG. 3 may be stored in a table or function as a transfer function for a fuel injector. The correction values may be adjusted or updated according to the method of FIG. 2. Thus, it may be possible to describe fuel injector flow in a fuel injector's ballistic operating range where the fuel injector may exhibit non-linear flow.

Referring now to FIG. 4, a fuel injector operating sequence for adjusting fuel injection according to the method of FIG. 2 is shown. Vertical markers T1-T6 represent times of interest during the sequence.

The first plot from the top of FIG. 4 is a plot of engine speed versus time. The Y axis represents engine speed and engine speed increases in the direction of the Y axis arrow. The X axis represents time and time increases from the left side of the plot to the right side of the plot.

The second plot from the top of FIG. 4 is a plot of engine air mass versus time. The Y axis represents engine air mass (e.g., air flow through the engine) and engine air mass increases in the direction of the Y axis arrow. The X axis represents time and time increases from the left side of the plot to the right side of the plot.

The third plot from the top of FIG. 4 is a plot of engine lambda versus time. The Y axis represents engine lambda and engine lambda increases in the direction of the Y axis arrow. The X axis represents time and time increases from the left side of the plot to the right side of the plot.

The fourth plot from the top of FIG. 4 is a plot of a first pulse width supplied to a direct fuel injector of a selected cylinder during a cycle of the selected cylinder versus time. The Y axis represents the first fuel pulse width and the first fuel pulse width increases in the direction of the Y axis arrow. The X axis represents time and time increases from the left side of the plot to the right side of the plot.

The fifth plot from the top of FIG. 4 is a plot of a second fuel pulse width supplied to the direct fuel injector of the selected cylinder during a cycle of the selected cylinder versus time. The Y axis represents the second fuel pulse width and the second fuel pulse width increases in the direction of the Y axis arrow. The X axis represents time and time increases from the left side of the plot to the right side of the plot.

The sixth plot from the top of FIG. 4 is a plot of port fuel injection fuel fraction versus time. The Y axis represents the port fuel injection fuel fraction and the port fuel injection fuel fraction increases in the direction of the Y axis arrow. The X axis represents time and time increases from the left side of the plot to the right side of the plot.

The seventh plot from the top of FIG. 4 is a plot of direct fuel injector fuel fraction versus time. The Y axis represents the direct fuel injector fuel fraction and the direct fuel injector fuel fraction increases in the direction of the Y axis arrow. The X axis represents time and time increases from the left side of the plot to the right side of the plot.

At time T0, the engine is operating at a constant engine speed with a constant air mass. The engine lambda value is one (e.g., the desired lambda value). The first pulse width provided to the direct fuel injector during a cycle of the cylinder receiving the fuel is at a middle level. The second pulse width provided to the direct fuel injector during the same cycle of the cylinder receiving the fuel is zero indicating that only one fuel pulse width is supplied to the second fuel injector during the cylinder cycle. The port injector fuel fraction is set to constant value that is greater than the direct injector fuel fraction.

At time T1, the engine speed and air mass remain at their respective constant values. The first pulse width supplied to the selected cylinder is decreased in response to a request to characterize the direct fuel injector. The second pulse width supplied to the selected cylinder is increased in response to the request to characterize the direct fuel injector. The first pulse width and the second pulse width are longer than a pulse width for entering the direct fuel injector's ballistic operating region where fuel injector flow is non-linear. The port and direct injector fuel fractions remain unchanged. The engine lambda value is steady at a value of one. The engine lambda value and the direct fuel injector pulse widths are stored to memory a short time after time T1 and before time T2.

At time T2, the engine speed and air mass continue to remain at their respective constant values. The first pulse width supplied to the selected cylinder is decreased further in response to the first fuel pulse width not being at a minimum value. The second pulse width supplied to the selected cylinder is also increased in response to the first fuel pulse width not being at the minimum value. The first fuel pulse width is short enough for the direct fuel injector to enter a non-linear or ballistic operating mode where fuel flow through the direct fuel injector may be non-linear. The engine lambda value increases indicating that the first fuel injector pulse width not supplying a desired amount of fuel and the fuel injector is in the ballistic region. The increased lambda value indicates that the direct fuel injector transfer function is providing a fuel pulse to the direct fuel injector resulting in a leaner air-fuel ratio than desired. The direct and port fuel fractions remain unchanged. The engine lambda value and the direct fuel injector pulse width are stored to memory a short time after time T2 and before time T3.

At time T3, the engine speed and air mass continue to remain at their respective constant values. The first pulse width supplied to the selected cylinder is decreased further in response to the first fuel pulse width not being at a minimum value. The second pulse width supplied to the selected cylinder is also increased in response to the first fuel pulse width not being at the minimum value. The first fuel pulse width drives the direct fuel injector to operate deeper in the direct fuel injector's non-linear operating region. The engine lambda value increases still more indicating that the first fuel injector pulse width is still in the ballistic region. The increased lambda value indicates that the direct fuel injector transfer function is providing a fuel pulse to the direct fuel injector resulting in a leaner air-fuel ratio than desired. The engine lambda value and the direct fuel injector pulse widths are stored to memory a short time after time T3 and before time T4.

At time T4, the engine speed and air mass continue to remain at their respective constant values. The first pulse width supplied to the selected cylinder is decreased further in response to the first fuel pulse width not being at a minimum value. The second pulse width supplied to the selected cylinder is also increased in response to the first fuel pulse width not being at the minimum value. The first fuel pulse width drives the direct fuel injector to operate even deeper in the direct fuel injector's non-linear operating region. The engine lambda value decreases a small amount indicating that the direct fuel injector's transfer function is providing a first fuel pulse width that is closer to the desired value that provides a lambda value of one. The lambda value indicates that the direct fuel injector transfer function needs to be corrected at shorter pulse widths of the first pulse width provided during the selected cylinder's cylinder cycle. The engine lambda value and the direct fuel injector pulse widths are stored to memory a short time after time T4 and before time T5.

At time T5, the engine speed and air mass continue to remain at their respective constant values and the first pulse width supplied to the selected cylinder is decreased further in response to the first fuel pulse width not being at a minimum value. The second pulse width supplied to the selected cylinder is also increased in response to the first fuel pulse width not being at the minimum value. The first fuel pulse width drives the direct fuel injector to operate still deeper in the direct fuel injector's non-linear operating region. The engine lambda value decreases a small amount indicating that the direct fuel injector's transfer function is providing a first fuel pulse width that is closer to the desired value that provides a lambda value of one. The lambda value indicates that the direct fuel injector transfer function needs to be corrected at shorter pulse widths of the first pulse width provided during the selected cylinder's cylinder cycle. The engine lambda value and the direct fuel injector pulse width are stored to memory a short time after time T5 and before time T6.

At time T6, the engine speed and air mass continue to remain at their respective constant values. The direct fuel injector is operated only based on a first pulse width provided to the direct fuel injector during the cylinder's cycle in response to the direct fuel injector pulse width having been reduced to a minimum value. The second fuel pulse width provided to the direct fuel injector is eliminated in response to the first pulse width having been reduced to a minimum value. The lambda value converges back to a value of one. The first direct fuel injector pulse width is a value that operates the direct fuel injector in a linear region that is outside of the ballistic region. The direct and port fuel injection fuel fractions remain unchanged.

After time T6, the direct fuel injector transfer function may be adjusted to improve the transfer functions characterization of direct fuel injector operation. In one example, the entries in the direct fuel injection transfer function may be adjusted by multiplying present values in the direct injector transfer function by a correction value that is based on the change in engine lambda from a nominal value as is described in the method of FIG. 2. The direct fuel injectors may be subsequently operated based on the revised transfer function.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example examples described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

This concludes the description. The reading of it by those skilled in the art would bring to mind many alterations and modifications without departing from the spirit and the scope of the description. For example, I3, I4, I5, I6, V8, V10, and V12 engines operating in natural gas, gasoline, diesel, or alternative fuel configurations could use the present description to advantage.

The invention claimed is:

1. A cylinder fueling method, comprising:

supplying a first pulse width and a second pulse width to a direct fuel injector of a first cylinder during a cycle of the first cylinder, the first pulse width operating the direct fuel injector in a non-linear operating region, the second pulse width operating the direct fuel injector in a non-ballistic operating region, and where an engine in which the direct fuel injector operates to supply fuel to the first cylinder operates with only port fuel injectors supplying fuel to the engine's cylinders other than the first cylinder when the direct fuel injector is operating in the non-linear operating region; and decreasing the first pulse width a plurality of times while simultaneously increasing the second pulse width the plurality of times until the first pulse width is less than a threshold pulse width.

2. The method of claim 1, where the non-linear operating region is an operating region where fuel flow through the direct fuel injector is non-linear.

3. The method of claim 1, further comprising:

adjusting a fuel injector gain or transfer function according to a lambda value resulting from the first pulse width.

4. The method of claim 1, where increasing the second pulse width includes increasing an amount of fuel injected via the second pulse width by an amount of fuel that is removed by decreasing the first pulse width during each of the plurality of times the first pulse width is decreased.

5. The method of claim 1, where the first cylinder is in the engine, and where the engine is operated at a constant speed and air mass when the direct fuel injector is operated in the non-linear operating region.

6. A method for fueling a cylinder, comprising:

operating an engine at a constant speed and air mass;

supplying a first fuel fraction to a cylinder of the engine via a first fuel injector while supplying a second fuel fraction to the cylinder via a second fuel injector; and supplying a first pulse width and a second pulse width to the second fuel injector during a cylinder cycle in response to a request to characterize the second fuel injector;

decreasing the first pulse width a plurality of times while simultaneously increasing the second pulse width the plurality of times until the first pulse width is less than a threshold pulse width;

adjusting a control parameter of the second fuel injector in response to an exhaust lambda produced while the second fuel injector is operating in a non-linear region; and operating the second fuel injector based on the adjusted control parameter.

7. The method of claim 6, where the first fuel injector is a port fuel injector, and where the second fuel injector is a direct fuel injector.

8. The method of claim 6, where increasing the second pulse width includes increasing an amount of fuel injected via the second pulse width by an amount of fuel that is removed by decreasing the first pulse width during each of the plurality of times the first pulse width is decreased.

9. The method of claim 8, where fuel delivered via the first pulse width and the second pulse width is based on providing a mixture in the cylinder having a lambda value of one.

10. The method of claim 6, where the control parameter is a transfer function or gain.

11. The method of claim 6, further comprising commanding the engine to operate at a constant air-fuel ratio while operating at the constant speed and air mass.

12. The method of claim 6, further comprising supplying fuel to other engine cylinders only via port fuel injectors while supplying the first pulse width and the second pulse width to the second fuel injector.

13. The method of claim 1, further comprising:

deactivating the direct fuel injector and operating the cylinder in an only port fuel injection mode when the first pulse width is less than the threshold pulse width.

14. The method of claim 13, further comprising:

supplying the first pulse width and the second pulse width to a direct fuel injector of a second cylinder after the first pulse width supplied to the direct fuel injector of the first cylinder is less than the threshold pulse width.

15. The method of claim 14, further comprising:

supplying a first fraction of fuel to the second cylinder during a cycle of the second cylinder via the direct fuel injector of the second cylinder and supplying a second fraction of fuel to the second cylinder during the cycle of the second cylinder via a port fuel injector.

16. The method of claim 15, further comprising:

operating cylinders of the engine other than the second cylinder with only port fuel injectors.

17. The method of claim 1, further comprising:

multiplying a lambda value with total number of cylinders in a bank of cylinders to determine a first value, and dividing the first value by a ratio of the first pulse width and the second pulse width to determine a fuel correction for the cylinder.

* * * * *